United States Patent [19]

Dunand et al.

[11] Patent Number: 4,893,830

[45] **Date of Patent: * Jan. 16, 1990**

[54] APPARATUS FOR THE RETENTION OF A BOOT ON A SKI

[75] Inventors: Josiane Dunand, Cran-Gevrier; Paul Arnulf, Alby sur Cheran; Denis Gasquet, Annecy, all of France

[73] Assignee: Salomon S.A., Annecy Cedex, France

[ * ] Notice: The portion of the term of this patent subsequent to Aug. 15, 2006 has been disclaimed.

[21] Appl. No.: 307,533

[22] Filed: Feb. 8, 1989

Related U.S. Application Data

[63] Continuation of Ser. No. 832,700, Feb. 25, 1986.

[30] Foreign Application Priority Data

Mar. 5, 1985 [EP] European Pat. Off. ..... 85400413

[51] Int. Cl.[4] ..... A63C 9/00

[52] U.S. Cl. ..... 280/615; 280/631

[58] Field of Search ..... 280/611, 615, 614, 631

[56] References Cited

U.S. PATENT DOCUMENTS

| | | | |
|---|---|---|---|
| 2,682,415 | 6/1954 | With | 280/615 |
| 3,920,257 | 11/1975 | Fredriksen | 280/615 |
| 4,049,291 | 9/1977 | Nunan | 280/614 |
| 4,109,932 | 8/1978 | With | 280/615 |
| 4,145,070 | 3/1979 | Berlied, Jr. | 280/615 |
| 4,239,257 | 12/1980 | Biermann et al. | 280/615 |
| 4,309,833 | 1/1982 | Salomon et al. | 280/615 |
| 4,382,611 | 5/1983 | Salomon | 280/615 |
| 4,438,947 | 3/1984 | Cooper | 280/615 |
| 4,484,762 | 11/1984 | Salomon | 280/615 |
| 4,496,169 | 1/1985 | Salomon et al. | 280/615 |
| 4,647,064 | 3/1987 | Salomon et al. | 280/615 |

FOREIGN PATENT DOCUMENTS

| | | | |
|---|---|---|---|
| 0171853 | 7/1952 | Austria | 280/614 |
| 0072766 | 2/1983 | European Pat. Off. | 280/615 |
| 0807789 | 7/1949 | Fed. Rep. of Germany | 280/614 |
| 2714990 | 10/1977 | Fed. Rep. of Germany | 280/615 |
| 2715907 | 10/1977 | Fed. Rep. of Germany | 280/615 |
| 2651562 | 5/1978 | Fed. Rep. of Germany | 280/614 |
| 2707626 | 8/1978 | Fed. Rep. of Germany | 280/615 |
| 3306165 | 8/1984 | Fed. Rep. of Germany | 280/614 |
| 1032305 | 2/1951 | France | 280/615 |
| 2355532 | 1/1978 | France | 280/614 |
| 2439602 | 5/1980 | France | 280/615 |
| 2447731 | 8/1980 | France | 280/615 |
| 2497674 | 7/1982 | France | 280/615 |
| 2527081 | 11/1983 | France | 280/615 |

OTHER PUBLICATIONS

European Patent Application No. 85400412.4.

*Primary Examiner*—Charles A. Marmor
*Assistant Examiner*—Eric Culbreth
*Attorney, Agent, or Firm*—Sandler & Greenblum

[57] ABSTRACT

An apparatus for retaining a boot on a ski including a mobile lock adapted to be displaced between a retention position and an open position. In the retention position the lock retains the boot on the ski. In the open position the lock permits the boot to be disengaged from the ski. Also provided is a generally upside down U-shaped spring in the form of a stirrup having a two ends which are pivotally attached to the ski and a median portion including a projection which extends toward these ends and which is adapted to be displaced on the surface of the lock. Both the lock and the spring are pivotally attached to the ski around different transverse axes so that the lock and the spring form a toggle mechanism. As a result, when the projection is displaced on the surface of the lock to one side of a plane passing through the two transverse axes, the lock is biased and displaced into one of its two positions. In order to position the lock into its other position, the skier need only pivot the projection to the other side of this plane. The stirrup includes an elastic deformation zone extending at least partially into the median portion of the spring.

39 Claims, 3 Drawing Sheets

APPARATUS FOR THE RETENTION OF A BOOT ON A SKI

This is a continuation of application Ser. No. 832,700 filed Feb. 25, 1986 now issued.

BACKGROUND OF THE INVENTION

1. Field of the Invention

The present invention relates to a ski binding. More particularly, the present invention relates to an elastic mechanism for a ski binding and a control element adapted to position the ski binding in an active retention position for retaining the end of a ski boot on a ski and/or in an inactive release position for releasing the end of a ski boot from the ski.

2. Description of Pertinent Information

Most known ski bindings comprise a pivoting lock comprising a first part which engages the boot at its end for example, and a second part which is subjected to the action of an elastic system. Also provided is a control element associated with the elastic system and the lock. The control element is adapted to place the binding in an active retention position for retaining the boot on the ski and/or in an inactive release position for releasing the end of the boot from the ski.

German patent application Ser. No. 26 51 562 for example, the control element comprises a lever pivoted on the same axis as the lock and kinematically linked to the elastic system. Positioning the control element and the elastic system in this binding is complicated due to the numerous parts of which it is composed, (pressure pulley, guidance axis, lever, spring, etc. . . . ), thereby resulting in a high production cost.

In other bindings such as the one described in German Pat. No. 807 789, the lock is composed of an elastically deformable material which comprises the lock itself and the elastic means of the binding. In this binding a lever is provided which is pivotally attached to the ski at a distance from the lock. The lever has a pressure finger adapted to rest upon a ramp of the lock in the active retention position of the lock to force the lock to rest on the end of the boot. However, this lock is difficult to manufacture because the binding must be made with an attaching portion which corresponds substantially to that of the end of the sole of the boot, while at the same time the binding must also comprise a zone or deformable portion allowing for its elastic locking without permitting the relative displacement of the sole of the boot with respect to the ski. Moreover, to place the binding in its active boot retention position it is necessary to release the lock from the action of the lever.

Austrian Pat. No. 171 853 relates to a binding comprising a lock and a control lever. The lock is adapted to grip only the end of the sole of the boot and the control lever comprises the elastic system. This binding also suffers the disadvantage of using a relatively large number of parts. In addition, the positioning of the lock in its inactive position requires the release of all of the force of the elastic system, and this force must be fully restored during the placing of the boot on the ski.

French Pat. No. 2 355 532 relates to a ski binding specifically adapted to retain the front end of a ski boot on a ski. This binding comprises a support element adapted to receive an attaching portion of the sole of the boot, an elastic system journaled on the ski, and a lock pivoting around a journal integral with the elastic system. This type of binding also comprises a control element comprising an extension of the lock positioned substantially on the opposite side of the binding from that portion of the binding adapted to contact the attaching portion of the sole of the boot. Such a binding has the disadvantage of releasing the lock from all action of the elastic system in its inactive position.

SUMMARY OF THE INVENTION

It is an object of the present invention to overcome the disadvantages of the prior art.

The invention which achieves this objective relates to an apparatus for retaining a boot on a ski. The apparatus comprises a mobile lock adapted to be positioned in a retention position for retaining a boot on a ski. In addition, the apparatus further comprises means for biasing the mobile lock in the retention position. The biasing means comprises a projection elastically biased against the lock. The biasing means is pivotally attached to the ski and the biasing means comprises a stirrup comprising a spring having the general shape of a U. In one embodiment the mobile lock comprises means for retaining a transverse bit extending from the front end of a boot.

The spring has the general shape of an a U having first and second ends which are pivotally connected to the ski. In addition, a projection is provided which extends toward the first and second ends of the spring. The stirrup further comprises a median portion comprising the projection, and an elastic deformation zone extending at least partially into the median portion.

The generally U-shaped shaped spring comprises first and second spaced apart lateral arms and the median portion comprises transverse arms connecting the first and second lateral arms. The first and second lateral arms are connected to the ski, the first end of the spring is on the first arm, and the second end of the spring is on the second arm. The projection extends from the transverse arms toward the first and second ends of the spring. The bottom section of the U-shaped spring is formed by the pivot axis of the first and second ends.

The projection comprises an activating portion adapted to contact the lock and two lateral arms extending away from the activating portion in the same direction so that the two lateral arms extend toward each other. The transverse arms comprise two spaced apart section extending transversely to the two lateral arms of the projection. Each of the two lateral arms of the projection is connected to a different spaced apart transverse arm of the spring.

The first and second ends of the spring are pivotally connected to the ski around a first axis, substantially transverse to the ski. This first axis extends through the longitudinal axis of the first and second ends of the spring. Also, the projection comprises first and second lateral arms. The first and second ends of the spring extend inwardly, substantially perpendicular to the first and second arms. In addition, the mobile lock is pivotally attached to the ski around a second axis substantially transverse to the ski. The first and second axes are substantially parallel to each other.

In one embodiment the median portion of the spring and the projection is in the general shape of an inverted Ω. This flexible zone of the median portion of the spring and the projection is elastically deformable.

In one embodiment the median portion comprises a flexible zone comprising at least one winding of the stirrup forming at least one spire. In this embodiment the flexible zone is elastically deformable and the projection is connected to the at least one spire and extends away from the spire and toward the first and second ends. In addition, the median portion can comprise two windings forming two spires such that the projection is connected to each spire and extends between the two spires.

In another embodiment the median portion and the projection comprise a flexible zone in the general shape of an 8. This flexible zone is elastically deformable. The generally 8-shaped flexible zone comprises a lower portion and an upper portion. The lower portion is wider than the upper portion, and the lower portion comprises a substantially rectilinear surface adapted to contact the surface of the lock.

The spring further comprises two spaced apart lateral arms. These lateral arms are bent at a substantially 90 degree angle to form the two ends of the spring. These two ends comprise means for journalling the biasing means on the ski.

In still another embodiment the generally U-shaped spring comprises two lateral arms, each having an end, and two sleeves each attached to one of the ends of the lateral arms. The apparatus further comprises a support element on the ski and two journals pivotally connecting each of the sleeves of the lateral arms to the support element so that the two journals form the pivoting axis of the biasing means.

In one embodiment the spring comprises one integral parts, and in an alternative embodiment the unitary spring is formed of two parts. In this alternative embodiment the median portion of the spring further comprises a flexible zone, and the apparatus further comprises means for linking the two parts of the spring in the flexible zone. The linking means can comprise an extension comprising a manipulation lever for biasing means.

The lock comprises means for retaining the front end of a ski boot, and in an alternative embodiment the lock comprises means for retaining the rear end of ski boot. In still another embodiment the mobile lock comprises an opening therein. The bottom portion of the opening is bounded by a downwardly sloping ramp. The projection of the spring is adapted to contact and be biased against the ramp. In addition, the projection is adapted to be displaced on the ramp such that the mobile lock is adapted to be displaced into its retention position in response to displacement of the projection on the ramp.

In still another embodiment the spring is journaled on the ski around a first transverse axis, and the movable lock is journaled on the ski around a second transverse axis. The projection is elastically biased against the movable lock at an activation point such that the position of the activation point on the movable lock changes in response to pivoting of the spring around the first transverse axis. The spring and the movable lock together comprise a toggle apparatus defined by the first and second transverse axes and the activation point. In addition, the movable lock is adapted to be displaced between open and retention positions. In the open position the lock permits the boot to be attached thereto and to be disengaged therefrom. In the retention position the lock retains the boot on the lock and the ski. The lock is displaced from one of these positions to the other of these positions in response to journaling of the spring. The spring is also adapted to be pivotally displaced. In this case of the spring, the spring is adapted to be displaced between open and closed positions in which the activation point is on either side of a plane passing through the first and second transverse axes defined above. In the open position the spring biases the movable lock against displacement out of the open position of the lock. In the closed position the spring biases the movable lock against displacement out of the retention position of the lock.

In the embodiment in which the movable lock is adapted to be displaced between open and retention positions, in which the lock is displaced from one of its positions to the other of its positions in response to journaling of the spring, and in which the spring is adapted to be pivoted between open and closed positions, the lock and the spring together constitute a toggle apparatus for producing substantially stable open and closed positions of the spring and substantially stable open and retention positions for the lock.

In still another embodiment the invention relates to an apparatus for securing a shoe or boot onto a ski. The apparatus comprises a movable lock adapted to be displaced between an open position and a locked position. In the open position the lock permits the boot to be released or attached to the ski. In the locked position the lock retains the boot on the ski. Also provided is means for elastically biasing the lock against displacement out of the open position when the movable lock is in the open position and for biasing the lock against displacement out of the locked position when the lock is in the locked position.

In this embodiment the biasing means is adapted to be displaced between open and closed positions and the lock is displaced into the locked position from its open position in response to displacement of the biasing means from its closed to its open position. Similarly, the lock is displaced into its open position from its closed position in response to displacement of the biasing means from its closed position to its open position. In addition, the movable lock is pivotally attached to the ski around a second transverse axis and the biasing means is pivotally attached to the ski around a first transverse axis. Further, the biasing means comprises a generally U-shaped spring comprising a projecting which is constantly biased against the surface of the lock at an activation point. This activation point is displaced in response to pivoting of the spring such that displacement of the activation point from one side to the other side of a plane passing through the first and second transverse axes displaces the lock into either its open or its locked position.

BRIEF DESCRIPTION OF THE DRAWINGS

The invention will be better understood by reference to the detailed description which follows in conjunction with the attached drawings in which.

DETAILED DESCRIPTION OF PREFERRED EMBODIMENTS

Figure 1:
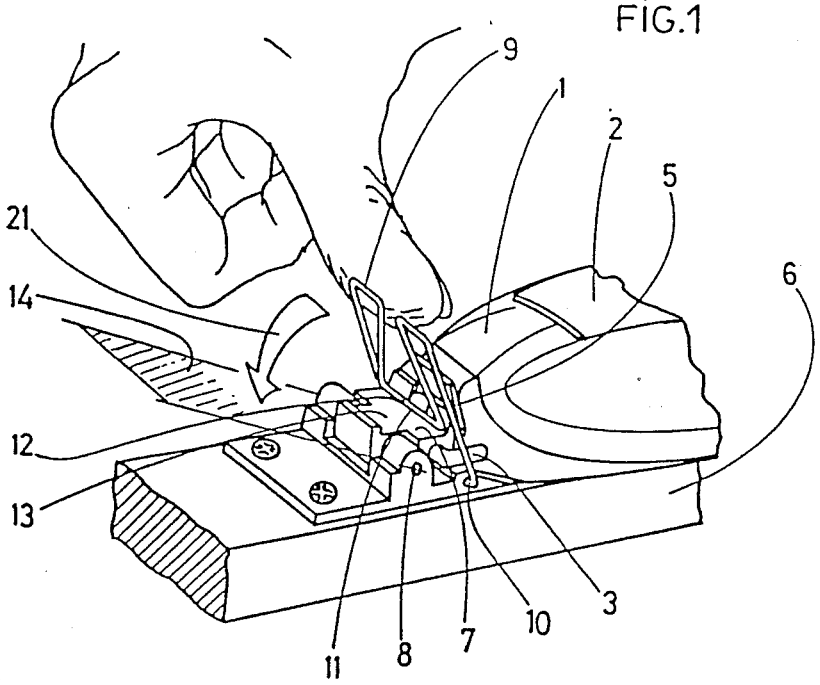
FIGS. 1 and 2 illustrate perspective views of the binding of the present invention which is adapted to link the front end of a boot to a ski and which comprises an elastic system shown in FIG. 1 in its active retention position for retaining the attaching portion of the boot, and shown in FIG. 2 in its inactive release position in which the attaching portion of the boot is adapted to be released from the ski and the lock.

It is an object of the present invention to remedy the disadvantages of the prior art in a simple and efficient manner by providing an elastic system comprising a spring having two parts. One part of the spring cooperates with a lock, while the other part of the spring comprises a control element. The combination of the lock and the spring is kinematically arranged so as to function as a toggle mechanism or elbow joint journal in which the spring remains subjected to tension when the lock is in one or the other of its active and inactive positions.

The present invention relates to a retention apparatus for retaining a boot on a ski. The apparatus comprises a mobile lock adapted to retain the boot on the ski in a retention position by an elastic system composed of a steel stirrup comprising a spring having the general shape of an upside-down U. The ends of the spring are pivotally attached to the ski. The median part of the stirrup comprises a projection which extends in the direction of the ends of the spring and which is adapted to rest elastically against the lock. The stirrup further comprises an elastic deformation zone which extends partially into the median part of the stirrup.

According to a first embodiment of the invention, the binding comprises a mobile lock and an elastic spring. The lock is pivotally attached to the ski around a second axis so that the lock pivots between a retention position and a release position. In the retention position the lock retains the sole of the boot on the ski. In the release position the lock releases the sole of the boot from the ski. The elastic spring comprises a stirrup in the general shape of a U having a median part and two lateral ends or branches. The two lateral ends or branches are pivotally attached to the ski around a first axis. This first axis is substantially parallel to the median part of the generally U-shaped spring. The median part of the spring is curved or bent in such a manner that it is elastically deformed when an activation point on the median part of the spring rests on an activation ramp on the surface of the lock. In addition, the median part of the spring is curved or bent so as to form a handle permitting the pivoting of the spring around its axis, thereby causing the displacement of its activation point on the ramp of the lock. The combination of the lock and the spring is kinematically arranged to function as a toggle mechanism or an elbow journal formed by the pivot axis of the lock, the pivot axis of the spring, and the activation point of the spring. As a result, when the activation point of the spring on the ramp of the lock is displaced beyond the plane defined by the pivot axis of the lock and the pivot axis of the spring, the elastic action of the spring causes the lock to pivot in the same direction as the displacement of the activation point of the spring. In addition, abutment means are preferably positioned on either side of the lock to limit the pivoting of the lock in its retention and/or release positions.

According to a preferred embodiment, the binding is of the type described in European patent application No. 85400412.4 filed Mar. 5, 1985, the disclosure of which is hereby incorporated by reference. More specifically, this preferred embodiment of the present invention relates to a binding adapted to link the front end of a boot to a ski. In this embodiment the portion of the boot that attaches the boot to the ski comprises a generally horseshoe shaped element having a substantially circular cross-sectional shape. This element is bent or curved in the general shape of a U and comprises lateral ends or branches. The lateral ends are anchored in the front portion of the boot. The binding comprises a support portion attached to the ski and adapted to receive the attaching portion of the boot by the downward displacement of this attaching portion of the boot on the support. The lock and the elastic system are disposed in the same manner as in the preceding embodiment, but in this embodiment the lock retains the attaching portion of the boot on the ski by means of a support portion.

Figure 2:
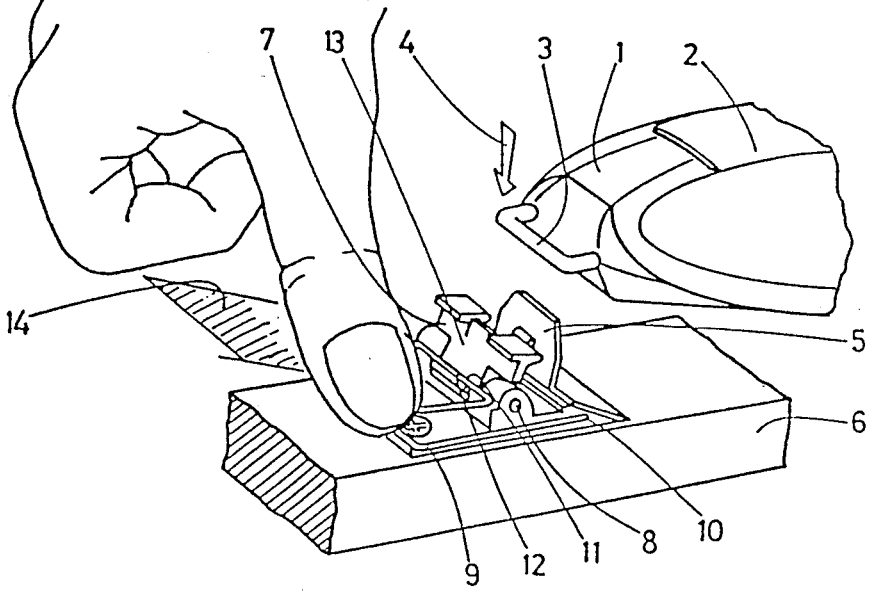

FIGS. 1 and 2 illustrate a preferred embodiment of the present invention in which an elastic system is associated with a cross-country ski binding. The binding comprises a support element 5, a mobile lock 7, and an elastic system 9, all of which are attached to a ski 6, Support element 5 is adapted to engage an attaching element 3 (in the form of a transverse bit) projecting in a known manner from a front end 1 of a boot when element 3 is downwardly displaced in direction 4 as illustrated in FIG. 2. Mobile lock 7 is pivotally attached to the ski around a journal or axis 8 so that lock 7 is adapted to pivot around a transverse axis passing through journal 8 between a retention position illustrated in FIG. 1 and an open release position illustrated in FIG. 2. In its retention position lock 7 retains boot 2 on ski 6. In its open release position lock 7 permits boot 2 to be removed ski 6 and permits boot 2 to engage support 5 of the binding.

Elastic system 9 comprises a stirrup-spring which is also pivotally attached to the ski around a journal or axis 10 so that elastic system 9 is adapted to pivot around a transverse axis passing through journal 10. Elastic system 9 is adapted to pivot between a closed position illustrated in FIG. 1 and an open position illustrated in FIG. 2. A portion of elastic system 9 contacts an activation ramp 13 of lock 7 at an activation point or line. This point or line of contact between elastic system 9 and activation ramp 13 of lock 7 is adapted to be displaced on ramp 13 as will be discussed below. Lock 7 and elastic system 9 are kinematically disposed to function as a toggle mechanism or elbow joint journal. In order to form this toggle mechanism journal 8 of lock 7 and journal 10 of the stirrup-spring form the first two support points of the toggle or elbow mechanism. The third support point is an activation point 11 of a projection 12 of a median part of stirrup-spring 9 on a ramp 13. Only this third support point, i.e. activation point 11, is adapted to be displaced with respect to ski 6. As a result of this structure, in order to pivot lock 7 between its open and its retention positions it is necessary to displace projection 12 of stirrup-spring 9 on ramp 13 from one side to the other side of a plane 14 defined by and passing through axes 8 and 10 to reverse the journaling of the elbow of the binding, thereby causing lock 7 to pivot from its retention position to its release position or from its release position to its retention position. Projection 12 can be so displaced by the skier pressing deformation zone 20 of spring 9 toward plane 14 as is illustrated in FIGS. 1 and 2. This toggle mechanism biases lock 7 and spring 9 against pivoting out of their retention and closed positions. In addition, this toggle mechanism biases lock 7 and spring 9 against pivoting out of their open positions. As a result, the present invention provides a lock 7 and a spring 9 having stable open and closed, retention positions.

Figure 3:
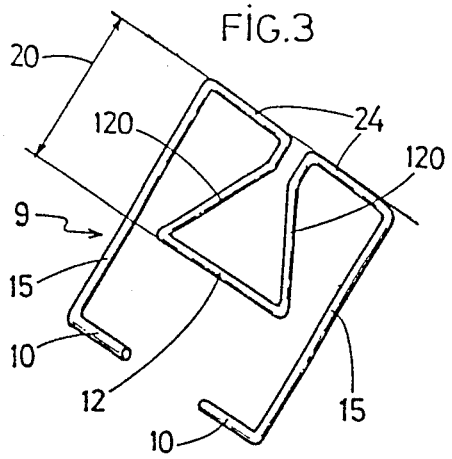
FIG. 3 is a perspective view showing the shape of one embodiment of the elastic system.
Figure 4:
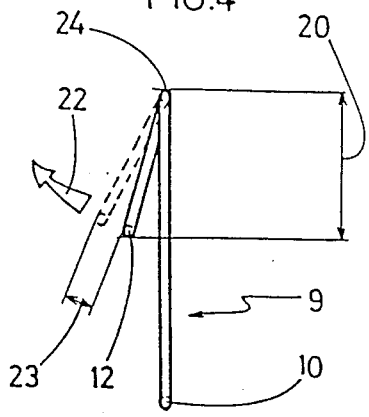
FIG. 4 is a side elevational view of the elastic system of the present invention illustrating the direction in which the elastic system is displaced during the performance of its function.

As is illustrated in more detail in FIGS. 3 and 4, elastic system 9 comprises a unitary wire spring in the shape of a stirrup. This stirrup-spring 9 comprises two attaching portions 10 for pivotally elastic system 9 to ski 6, two lateral arms or branches 15, two transverse arms or branches 24, and a median portion positioned between lateral arms 15. Attaching portions 10 comprise the ends of elastic system 9 and form a journal for pivotally attaching elastic system 9 to the ski. In addition, attaching portions 10 extend inwardly at a substantially right angle to lateral arms 15. The median portion is in the general shape of an inverted Ω and comprises a projection 12 and two upwardly converging lateral arms or branches 120. Projection 12 is adapted to rest upon an activation zone, such as ramp 13 of lock 7. Stirrup-spring 9 further comprises an elastically deformable zone 20 which is illustrated in FIGS. 3 and 4. This zone 20 comprises arms 120, and arms 24.

This construction of stirrup-spring 9 is particularly advantageous for ski bindings which require a reduced size and minimum weight, such as cross-country ski bindings as illustrated in FIGS. 1 and 2. This reduced size and weight is the result of designing stirrup-spring 9 to serve several functions that were heretofor performed by several elements. For example, spring 9 biases the binding to hold the boot on the ski, spring 9 is one of the functional elements of the lock system, and spring 9 serves as a voluntary manipulation element of said binding which is adapted to be manipulated by the voluntary action of the skier to position the lock in its retention and release positions. Another advantage of the present invention resides in the positioning of elastic deformation zone 20 of stirrup-spring 9 above projection 12. As a result, there is space above projection 12 to form the spring in the most appropriate shape for the desired elastic action on lock 7. For example, in the embodiment illustrated in FIGS. 1–4 zone 20 is adapted to be flexed in direction 22 by the distance 23, for example, as illustrated in FIG. 4., which produces a particular elastic force. In its unflexed state, zone 20 of stirrup-spring 9 can be seen to extend substantially in a plane oblique to the plane of lateral arms 15. Finally, it should be noted that the elastic system of the present invention occupies a relatively small volume, particularly in the transverse direction, which permits the pivoting of spring 9 in direction 21, as seen in FIG. 1, toward the upper surface of ski 6 simultaneously with the rotation of lock 7, as is illustrated in FIG. 2. In this first embodiment of stirrup-spring 9, the elastic bias of the spring is provided by the resistance of branches 24 to pivoting.

Figure 6:
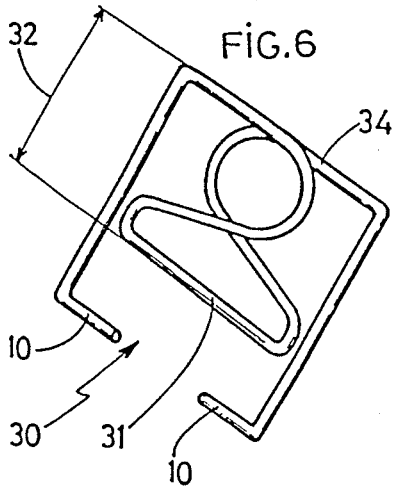
FIGS. 5 and 6 illustrate perspective views showing the shape of alternative embodiments of the elastic system according to which the elastic system is formed from a single strand or branch.
Figure 5:
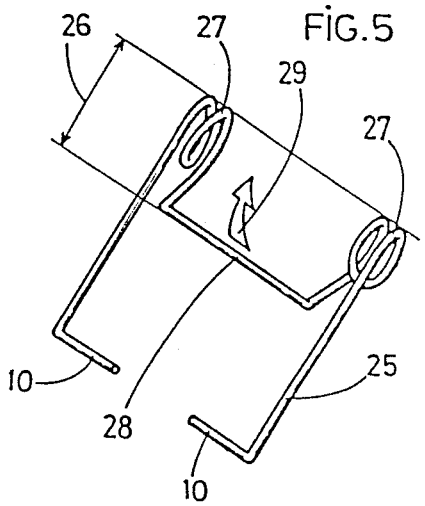

In order to obtain a spring with different mechanical characteristics and/or whose elastic constraints greater or smaller than the embodiment illustrated in FIGS. 1–4, the embodiments illustrated in FIGS. 5 and 6 can be used. In these embodiments the binding comprises, respectively, a stirrup-spring 25 and a stirrup-spring 30. These stirrup-springs are harder to flex than the spring illustrated in FIGS. 1–4 by virtue of the specific curves formed in these springs. Thus, in FIG. 5 elastic deformation zone 26 comprises a winding in the transverse branches of the spring. This winding forms a plurality of spires 27. Also provided is a projection 28 which is adapted to be elastically applied on the lock. In addition, projection 38 is adapted to be displaced in the direction of trajectory 29, for example, by flexing spires 27. In the embodiment illustrated in FIG. 6 stirrup-spring 30 comprises an elastic deformation zone 32 comprising crossed windings that are formed by transverse apron 34 of the spring. These windings 30 are substantially in the shape of an "8" having a flattened base 31. Base 31 constitutes a projection adapted to be elastically applied to a surface of the lock.

Figure 7:
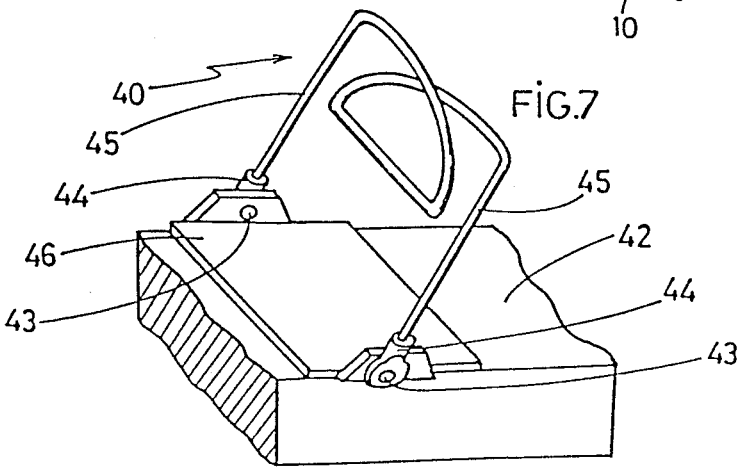
FIG. 7 illustrates another embodiment of the present invention in which the elastic system is journaled on the ski.

FIG. 7 illustrates still another embodiment. In this embodiment the binding comprises a stirrup-spring 40 which is pivotally attached to ski 42 around a transverse axis. Stirrup-spring 40 comprises two lateral branches 45, each of which has an end that is integral with sleeves or cylinders 44. Spring 40 further comprises two journals 43 which are each attached to one of sleeves 44 and a support element 46 attached to the ski. Journals 43 pivotally attach sleeves 44 to ski 42. In addition, the median portion of spring 40 comprises a projection adapted to be elastically applied to the lock and two crossed arms.

Figure 8:
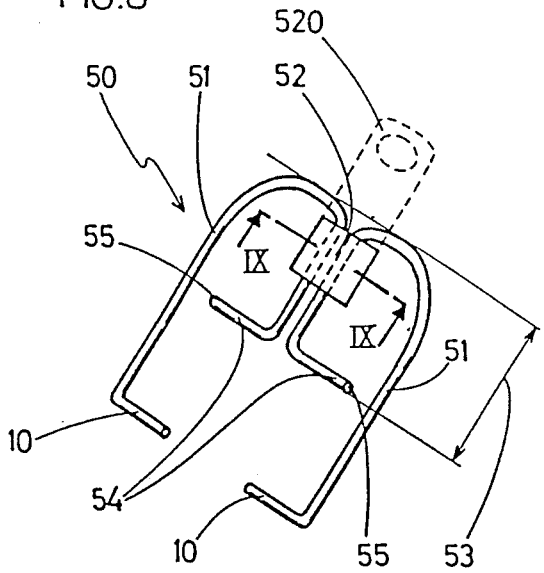
FIG. 8 illustrates a perspective view of the elastic system of the present invention in which the elastic system comprises two segments or branches assembled together by a staple.
Figure 9:
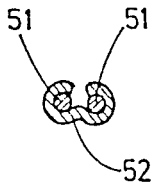
FIG. 9 is a cross-sectional view taken along line IX—IX in FIG. 8 of the elastic system of FIG. 8 showing the assembly of the segments or branches in detail.

FIGS. 8 and 9 illustrates another embodiment of the stirrup-spring. In this embodiment a stirrup spring 50 comprises two parts 51 which are linked by a sleeve or housing or staple 52 so as to form one assembly. Parts 51 are linked in an elastic deformation zone 53 of the spring, but it is also within the scope of the invention to link parts 51 at the level of projection 54. In addition, it is also within the scope of the present invention to fold parts 51 differently than illustrated in FIGS. 8 and 9, for example, so that their ends 55 are facing one another rather than extending away from each other as illustrated in FIG. 8. Furthermore, it is also within the scope of the present invention for assembly sleeve 52 to comprise a manipulation element of the elastic system on the lock. In this embodiment sleeve 52 would comprise, for example, an extension 520 forming a lever and represented in dashed lines on FIG. 8.

Figure 10:
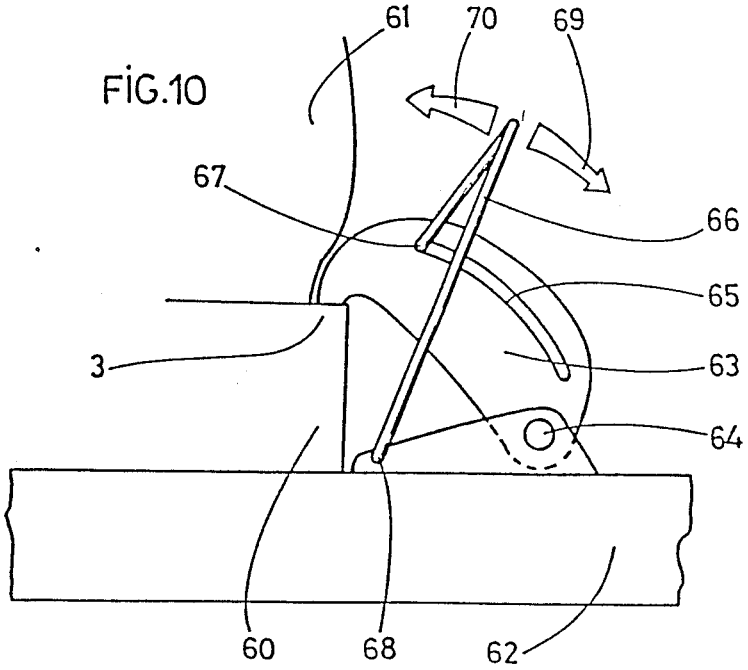
FIG. 10 is a schematic side elevational view of an alternative embodiment of the binding of the present invention which is adapted to retain the rear end of a boot on a ski and which is equipped with an elastic system in accordance with the present invention.

The elastic system of the present invention can also be adapted to other types of bindings. Such an adaptation is illustrated in FIG. 10. In FIG. 10 the binding illustrated therein is adapted to retain the rear end 60 of a boot 61 on a ski 62. A lock 63 is pivotally attached to the ski around a transverse axis or journal 64. Lock 63 comprises a downwardly sloped opening therein which is bounded on its lower end by an activation ramp 65. A projection 67 of a stirrup-spring 66 is adapted to be elastically applied to ramp 65. Spring 66 is pivotally attached to the ski at a distance from axis 64 around another axis or journal 68 in such a manner that by manipulating the spring to its open release position so as to pivot lock 63 into its release position in direction 69, the elastic bias of projection 67 on ramp 65 is released and, therefore, there is no bias on lock 63. Conversely, spring 66 is pivotally attached to the ski in such a manner that by manipulating the spring to its closed position so as to pivot lock 63 to its retention position in direction 70 spring 66 exerts an elastic force on lock 63 by pushing projection 67 on the upper end of ramp 65.

It is also within the scope of the invention to insert an element between the projection of the spring and the lock, and it is also within the scope of the invention to associate the lock with a means for gripping the boot, such as a jaw, which would be adapted to cooperate with the attaching part of the sole of the boot.

Although the invention has been described with respect to particular means, methods and embodiments it is not limited thereto, but extends to all equivalents within the scope of the claims.

What is claimed is:

1. A cross-country ski binding for the retention of a shoe or boot on a ski comprising a mobile lock for engaging a front portion of said shoe or boot for retaining said front portion of said shoe or boot on a ski and for allowing a rear portion of said shoe or boot to be raised from said ski, a control lever for moving said mobile lock between a stable lock position and a stable unlocking position, an elastic system for biasing said lock in said stable lock position, wherein movement between said stable positions is performed by means of a toggle-joint system, wherein said elastic system comprises an actuating member for said mobile lock which, together with said mobile lock, constitutes said toggle-joint system, and wherein said elastic system further comprises said control lever.

2. The binding defined by claim 1 wherein said mobile lock comprises means for retaining a transverse bit extending from said front portion of said shoe or boot.

3. The binding defined by claim 1 wherein said elastic system comprises a U-shaped stirrup having first and second ends, wherein said first and second ends are pivotally connected relative to said ski.

4. The binding defined by claim 1 wherein said elastic system comprises a spring which is journaled relative to said ski around a first transverse axis, wherein said mobile lock is journaled relative to said ski around a second transverse axis, wherein said spring comprises a projection which is elastically biased against said mobile lock at an activation point, wherein the position of said activation point on said mobile lock changes in response to pivoting of said spring around said first transverse axis.

5. The binding defined by claim 1 wherein in said unlocking position said lock permits said shoe or boot to be attached thereto and to be disengaged therefrom wherein in said lock position said lock retains said shoe or boot between said lock and said ski.

6. The binding defined by claim 1 wherein said elastic system extends substantially in a plane.

7. The binding defined by claim 1 wherein said mobile lock is journaled relative to said ski about a first axis and said elastic system is journaled relative to said ski about a second axis, wherein said said first axis and said second axis are located in a plane which define a neutral position of said toggle-joint system.

8. The binding defined by claim 7 wherein said elastic system comprises an activation portion which is displaceably mounted with respect to said mobile lock.

9. The binding defined by claim 8 wherein said mobile lock comprises a pair of spaced abutments, between which said activation portion of said elastic system is mounted for movement and by which said movement is limited.

10. The binding defined by claim 1 wherein said elastic system comprises a U-shaped stirrup having a first lateral arm and a second lateral arm, and wherein said stirrup is journaled relative to said ski by an end of said first lateral arm and by an end of said second lateral arm.

11. The binding defined by claim 10 wherein said U-shaped stirrup is constituted by a spring, wherein said stirrup comprises a median portion between said first lateral arm and said second lateral arm, wherein said median portion comprises a projection which constitutes an activation portion of said elastic system and which is elastically biased against said mobile lock.

12. The binding defined by claim 11 wherein said median portion of said spring and said projection comprise a flexible zone in the general shape of an inverted omega.

13. The binding defined by claim 12 wherein said flexible zone of said median portion of said spring and said projection is elastically deformable.

14. The binding defined by claim 11 wherein said median portion of said spring comprises a flexible zone comprising at least one winding of said stirrup forming at least one spire.

15. The binding defined by claim 14 wherein said flexible zone is elastically deformable.

16. The binding defined by claim 14 wherein said projection is connected to said at least one spire and extends away from said at least one spire and toward said first and second ends.

17. The binding defined by claim 16 wherein said median portion of said spring comprises two winding forming two spires, wherein said projection is connected to each spire and extends between said two spires.

18. The binding defined by claim 11 wherein said projection is a flexible zone in the general shape of an 8.

19. The binding defined by claim 18 wherein said flexible zone is elastically deformable.

20. The binding defined by claim 18 wherein said generally 8-shaped flexible zone comprises a lower portion and an upper portion, wherein said lower portion is wider than said upper portion, wherein said lower portion comprises a substantially rectilinear surface adapted to contact the surface of said lock.

21. The binding defined by claim 11 wherein said lateral arms are bent at a substantially 90 degree angle to form said two ends, wherein said two ends comprise means for journalled said stirrup on said ski.

22. The binding defined by claim 11 further comprising two sleeves each attached to one of said ends of said lateral arms, wherein said binding further comprises a support element on said ski and two journals pivotally connecting each of said sleeves of said lateral arms to said support element, wherein said two journals form the pivoting axis of said biasing means.

23. The binding defined by claim 11 wherein said spring comprise one integral piece.

24. The binding defined by claim 11 wherein said spring is a unitary member comprising two parts, wherein said median portion of said spring further comprises a flexible zone, wherein said apparatus further comprises means for linking said two parts of said spring in said flexible zone.

25. The binding defined by claim 24 wherein said linking means comprises an extension comprising said control lever of said elastic system.

26. The binding defined by claim 11 wherein said median portion of said U-shaped stirrup further comprises two transverse arms extending between said first lateral arms said second lateral arm, wherein said projection extends from said two transverse arms toward said ends of said first lateral arm and said second lateral arm.

27. The binding defined by claim 26 wherein said projection comprises an activating portion adapted to contact said lock and two lateral arms extending away from said activating portion in the same general direction, wherein said two lateral arms of said projection extend toward each other.

28. The binding defined by claim 27 wherein said transverse arms comprise two spaced apart sections extending transversely to said two lateral arms of said projection, wherein each of said two lateral arms of said projection is connected to a different spaced apart section of said transverse arm of said spring.

29. The binding defined by claim 11 wherein said ends of said first lateral arm and said second lateral arm pivotally connect said spring relative to said ski about a first axis.

30. The binding defined by claim 29 wherein said first lateral arm and said second lateral arm include inwardly extending portions which are substantially perpendicular to said first lateral arm and which extend along said axis.

31. The binding defined by claim 29 wherein said mobile lock is pivotally attached relative to said ski around a second axis substantially transverse to said ski, wherein said first and second axes are substantially parallel to each other.

32. An apparatus for retaining a boot on a ski comprising:

(a) a mobile lock adapted to be positioned for movement between a retention position for retaining a boot on the ski and an open position for permitting said boot to be removed from said ski; and (b) means for biasing said mobile lock in said retention position and in said open position, wherein said biasing means is a wire stirrup having a general U shape comprising a projection integral with said wire stirrup elastically biased against and engaging said mobile lock for moving said mobile lock between said retention position and said open position, and wherein said stirrup is pivotally fixed relative to said ski, said stirrup comprising a manipulation lever for manipulating said biasing means relative to said mobile lock.

33. The apparatus of claim 32 wherein said said wire stirrup is a unitary, one-piece member.

34. The apparatus of claim 32 wherein said stirrup comprises a pair of lateral arms which generally lie in a first plane and wherein said projection is connected to a portion of said stirrup, said projection lying in a second plane which is angled relative to said first plane.

35. The apparatus of claim 32 wherein said biasing means is pivotally movable relative to the ski about a first transverse axis and wherein said mobile lock is pivotally movable relative to the ski about a second transverse axis.

36. The apparatus of claim 35 wherein said mobile lock comprises an activation surface, wherein said projection of said biasing means engages said activation surface of said mobile lock at an activation point, wherein said activation point is displaced in response to pivoting of said stirrup, wherein displacement of said activation point from one side to the other side of a plane passing through said first and second transverse axes displaces a said mobile lock into one of said open and lock positions.

37. The apparatus of claim 36 wherein said biasing means and said mobile lock comprise a bi-stable toggle system wherein said mobile lock is selectively biased into said open position or said retention position.

38. The apparatus of claim 37 wherein said first and second transverse axes define a plane which constitutes a neutral position of said bi-stable toggle system.

39. The binding defined by claim 32 wherein said mobile lock comprises an opening therein, wherein the bottom portion of said opening is bounded by a ramp, wherein said ramp slopes downwardly, wherein said projection is adapted to contact and be biased against said ramp, wherein said projection is adapted to be displaced on said ramp, wherein said mobile lock is adapted to be displaced into said lock position in response to displacement of said projection on said ramp.

* * * * *

UNITED STATES PATENT AND TRADEMARK OFFICE

CERTIFICATE OF CORRECTION

PATENT NO. : 4,893,830

DATED : January 16, 1990

INVENTOR(S) : J. DUNAND et al.

It is certified that error appears in the above-identified patent and that said Letters Patent is hereby corrected as shown below:

column 2, line 23, delete "an";
column 2, line 30, change "U-shaped shaped" to —U-shaped—;
column 2, line 45, change "section" to —sections—;
column 3, line 28, change "parts" to —part—;
column 3, line 38, insert —a— after "of";
column 3, line 65, change "this" to —the—;
column 4, line 40, change "projecting" to —projection—;
column 5, line 2, change "strand" to —segment—;
column 6, line 37, insert —2— after "boot";
column 6, line 46, insert —from— after "removed";
column 7, line 20, insert —attaching— after "pivotally";
column 7, line 34, delete "," after "120";
column 8, line 12, change "38" to —28—;
column 8, line 17, change "apron" to —arms—;

UNITED STATES PATENT AND TRADEMARK OFFICE

CERTIFICATE OF CORRECTION

PATENT NO. : 4,893,830

DATED : January 16, 1990

INVENTOR(S) : J. DUNAND et al.

It is certified that error appears in the above-identified patent and that said Letters Patent is hereby corrected as shown below:

column 8, line 17, delete "30";
column 8, line 33, change "illustrates" to ——illustrate——;
column 9, line 1, insert ——,—— after "70";
column 9, line 55, change "said said" to ——said——;
column 10, line 29, (claim 17, line 2) change "winding" to ——windings——;
column 10, line 46, (claim 21, line 4) change "journalled" to ——journalling——;
column 10, line 55, (claim 23, line 2) change "comprise" to ——comprises——;
column 10, line 68, (claim 26, line 4) change "arms" to ——arm and——; and
column 12, line 25, (claim 36, line 9) after "displaces" delete "a".

Signed and Sealed this

Twenty-second Day of October, 1991

*Attest:*

*Attesting Officer*

HARRY F. MANBECK, JR.

*Commissioner of Patents and Trademarks*